US010610727B1

(12) United States Patent
Washington

(10) Patent No.: US 10,610,727 B1
(45) Date of Patent: Apr. 7, 2020

(54) EXERCISE SLIDERMAT

(71) Applicant: David Washington, Omaha, NE (US)

(72) Inventor: David Washington, Omaha, NE (US)

( * ) Notice: Subject to any disclaimer, the term of this patent is extended or adjusted under 35 U.S.C. 154(b) by 102 days.

(21) Appl. No.: 15/985,953

(22) Filed: May 22, 2018

(51) Int. Cl.
*A63B 22/20* (2006.01)
*A63B 23/04* (2006.01)
*A63B 21/00* (2006.01)

(52) U.S. Cl.
CPC ..... *A63B 22/203* (2013.01); *A63B 23/04* (2013.01); *A63B 21/4037* (2015.10); *A63B 2208/0204* (2013.01)

(58) Field of Classification Search
CPC ... A63B 6/00; A63B 21/00185; A63B 21/012; A63B 21/0125; A63B 21/015; A63B 21/065; A63B 21/068; A63B 21/08; A63B 21/15; A63B 21/16; A63B 21/4023; A63B 21/4027; A63B 21/4029; A63B 21/4031; A63B 21/4033; A63B 21/4034; A63B 21/4037; A63B 21/4041; A63B 21/4045; A63B 22/0046; A63B 22/20; A63B 22/201; A63B 22/203; A63B 22/208; A63B 2022/206; A63B 23/035; A63B 23/03508; A63B 23/03516; A63B 23/04; A63B 23/0405; A63B 23/0417; A63B 23/047; A63B 23/0482; A63B 23/0488; A63B 23/0494; A63B 69/0022; A63B 69/0028; A63B 69/0035; A63B 69/0093; A63B 69/18; A63B 69/182; A63B 69/187; A63B 2069/0031; A63B 2208/0204; A63B 2208/0209; A63B 2225/09; A63B 2244/18; A63B 2244/183; A63B 2244/186
See application file for complete search history.

(56) References Cited

U.S. PATENT DOCUMENTS 2,274,081 A * 2/1942 Mautin ..... A63B 69/18 482/71
3,372,930 A * 3/1968 Sertich ..... A63B 22/14 473/452
3,582,066 A * 6/1971 Keryluk ..... A63B 69/18 482/71
4,391,441 A * 7/1983 Simjian ..... A63B 22/14 482/131
4,640,508 A * 2/1987 Escher ..... A63B 21/22 482/110

(Continued)

*Primary Examiner* — Gary D Urbiel Goldner
(74) *Attorney, Agent, or Firm* — Kyle A. Fletcher, Esq.

(57) ABSTRACT

The exercise slidermat comprises a stationary saucer and sliding structure. The stationary saucer is a pedestal upon which the sliding structure is placed. The sliding structure sits the stationary saucer such that the sliding structure slides along the stationary saucer. The sliding structure is a horizontal surface upon which an exerciser performs training exercises intended to improve the footwork for a given sport. The sliding structure is moved across the stationary saucer such that the sliding structure is moving across the stationary saucer while the exerciser is performing the training exercises. The action of combining the motion of the sliding structure with the physical training causes the exerciser to perform the training exercises while visually and tactilely sensing not only the motion of the training exercise but the forces and momentum applied to the sliding structure during the training period.

14 Claims, 3 Drawing Sheets

(56) References Cited

U.S. PATENT DOCUMENTS 4,684,124 A * 8/1987 Escher ..... A63B 21/0004 482/110
4,703,928 A * 11/1987 Escher ..... A63B 21/0004 482/110
4,779,862 A * 10/1988 Keppler ..... A63B 69/0022 482/51
4,940,226 A * 7/1990 Carra ..... A63B 69/0022 434/253
4,946,160 A * 8/1990 Bertoletti ..... A63B 22/18 482/146
5,114,387 A 5/1992 Keppler
5,133,700 A * 7/1992 Braathen ..... A63B 69/0022 472/118
5,322,490 A 6/1994 van der Hoeven
5,326,338 A * 7/1994 Makous ..... A63B 69/0022 434/253
5,352,165 A 10/1994 Koblick
5,393,282 A * 2/1995 Maclean ..... A63B 69/0022 482/51
5,399,140 A * 3/1995 Klippel ..... A63B 22/18 482/123
5,509,870 A * 4/1996 Lloyd ..... A63B 69/0022 434/253
6,468,187 B1 10/2002 Boatwright
6,543,769 B1 * 4/2003 Podoloff ..... A63B 21/0004 273/148 B
7,300,392 B1 * 11/2007 Curran ..... A63B 21/0004 482/146
7,775,952 B1 * 8/2010 Curran ..... A63B 22/18 482/146
D633,158 S 2/2011 Bruschke
8,043,199 B1 * 10/2011 Barker ..... A63B 22/0023 482/132
8,784,230 B1 * 7/2014 Mitchell ..... A63B 69/0057 473/271
8,858,402 B2 10/2014 Bruschke
8,992,389 B2 * 3/2015 Abel ..... A63B 69/0057 482/51
9,259,611 B2 2/2016 Abel
9,861,220 B2 * 1/2018 Burkhalter ..... A47G 27/0231
9,962,574 B2 * 5/2018 Sperry ..... A63B 22/16
10,101,805 B2 * 10/2018 Choi ..... A63B 69/0035
10,232,218 B2 * 3/2019 Carr ..... A63B 22/203
2007/0027010 A1 * 2/2007 Tsai ..... A63B 21/0004 482/146
2007/0054791 A1 * 3/2007 Langer ..... A63B 21/0004 482/146
2009/0111670 A1 * 4/2009 Williams ..... A63B 23/0464 482/146
2011/0230312 A1 * 9/2011 Gamboa ..... A63B 22/20 482/51
2011/0230313 A1 * 9/2011 Gamboa ..... A63B 22/20 482/51
2013/0237393 A1 * 9/2013 Kerdjoudj ..... A63B 21/018 482/122
2013/0252791 A1 * 9/2013 Chang ..... A63B 22/20 482/132
2016/0067541 A1 * 3/2016 Lopez ..... A63B 23/03575 482/124
2016/0089576 A1 * 3/2016 Rosenstiel ..... A63B 26/003 482/146
2016/0168805 A1 6/2016 Schumann
2017/0172331 A1 * 6/2017 Publicover ..... A63B 5/11
2018/0193712 A1 * 7/2018 Lestrade ..... A61B 5/6895

* cited by examiner

EXERCISE SLIDERMAT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of sports including apparatus for physical training, more specifically, an exercise apparatus adapted for limbs.

SUMMARY OF INVENTION

The exercise slidermat is a physical training apparatus. The exercise slidermat is used for physical training in sports footwork. The exercise slidermat comprises a stationary saucer, a sliding structure, and an interface surface. The stationary saucer is a pedestal upon which the sliding structure is placed. The sliding structure sits on a superior surface of the stationary saucer such that the sliding structure slides along the superior surface of the stationary saucer. The sliding structure is a horizontal surface upon which an exerciser performs training exercises intended to improve the footwork for a given sport. The sliding structure is moved across the stationary saucer such that the sliding structure is moving across the stationary saucer while the exerciser is performing the training exercises. The action of combining the motion of the sliding structure with the physical training causes the exerciser to perform the training exercises while visually and tactilely sensing not only the motion of the training exercise but the forces and momentum applied to the sliding structure during the training period. The additional stimuli of the forces and momentum created by the movement of the sliding structure works to improve: 1) the overall balance of the exerciser; and, 2) the ability of the exerciser to maintain proper footwork when facing the dynamic environment often associated with sports such as American football, wrestling, soccer, skiing or volleyball. The interface surface is a low friction surface positioned between the stationary saucer and the sliding structure.

These together with additional objects, features and advantages of the exercise slidermat will be readily apparent to those of ordinary skill in the art upon reading the following detailed description of the presently preferred, but nonetheless illustrative, embodiments when taken in conjunction with the accompanying drawings.

In this respect, before explaining the current embodiments of the exercise slidermat in detail, it is to be understood that the exercise slidermat is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the exercise slidermat.

It is therefore important that the claims be regarded as including such equivalent construction insofar as they do not depart from the spirit and scope of the exercise slidermat. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
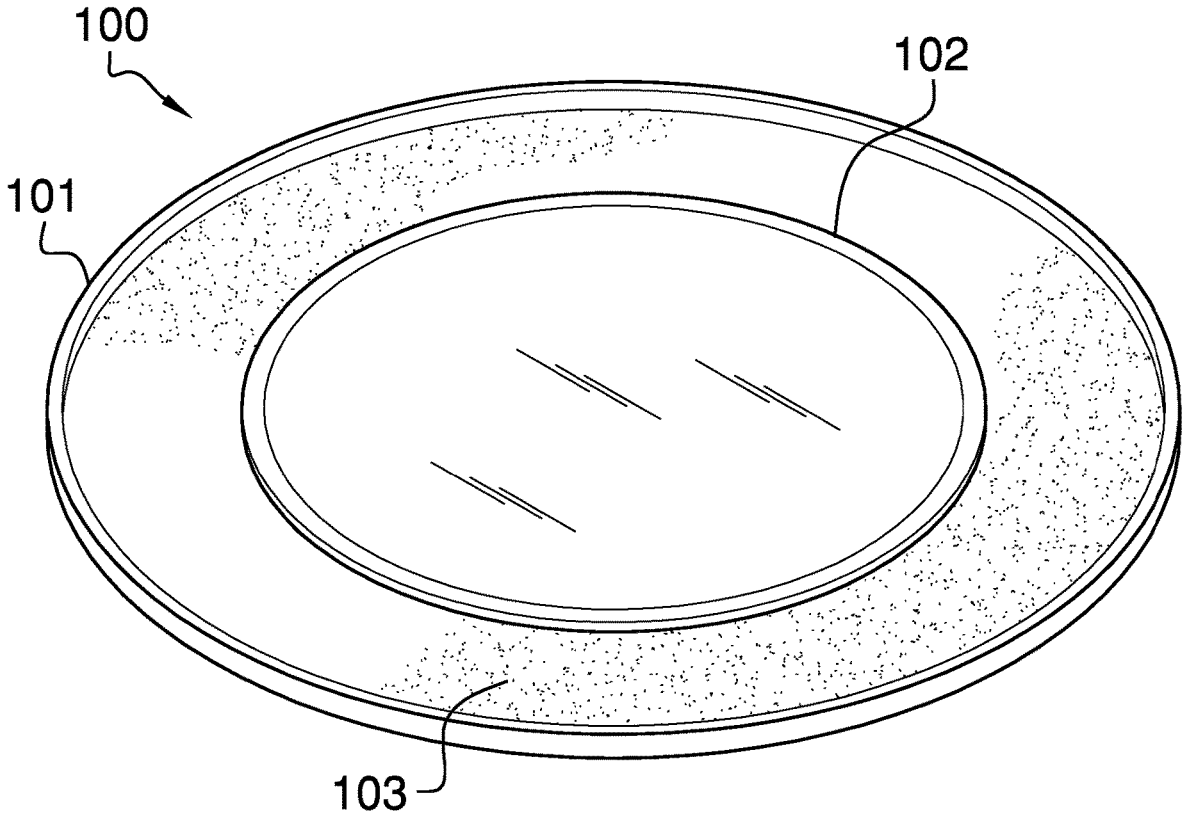
FIG. 1 is a perspective view of an embodiment of the disclosure.
Figure 2:
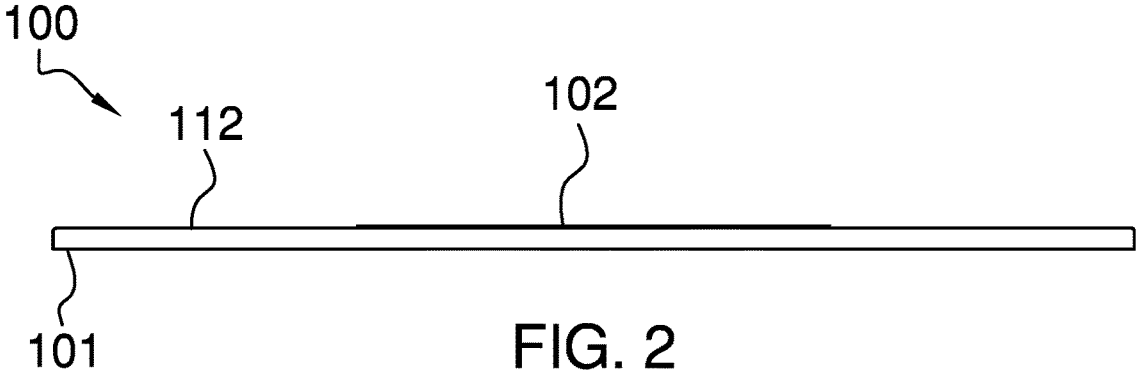
FIG. 2 is a side view of an embodiment of the disclosure.
Figure 3:
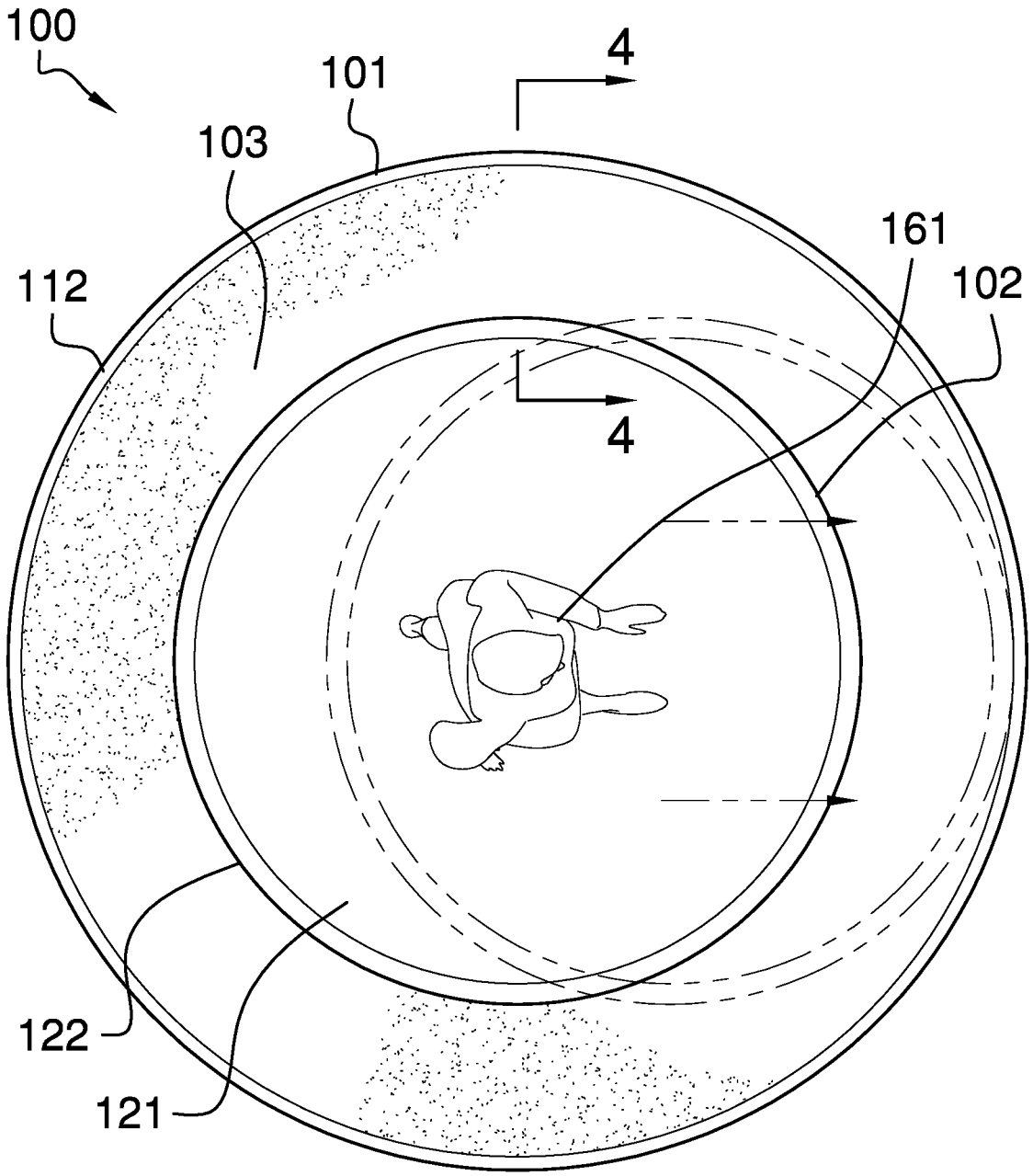
FIG. 3 is a top view of an embodiment of the disclosure.
Figure 4:
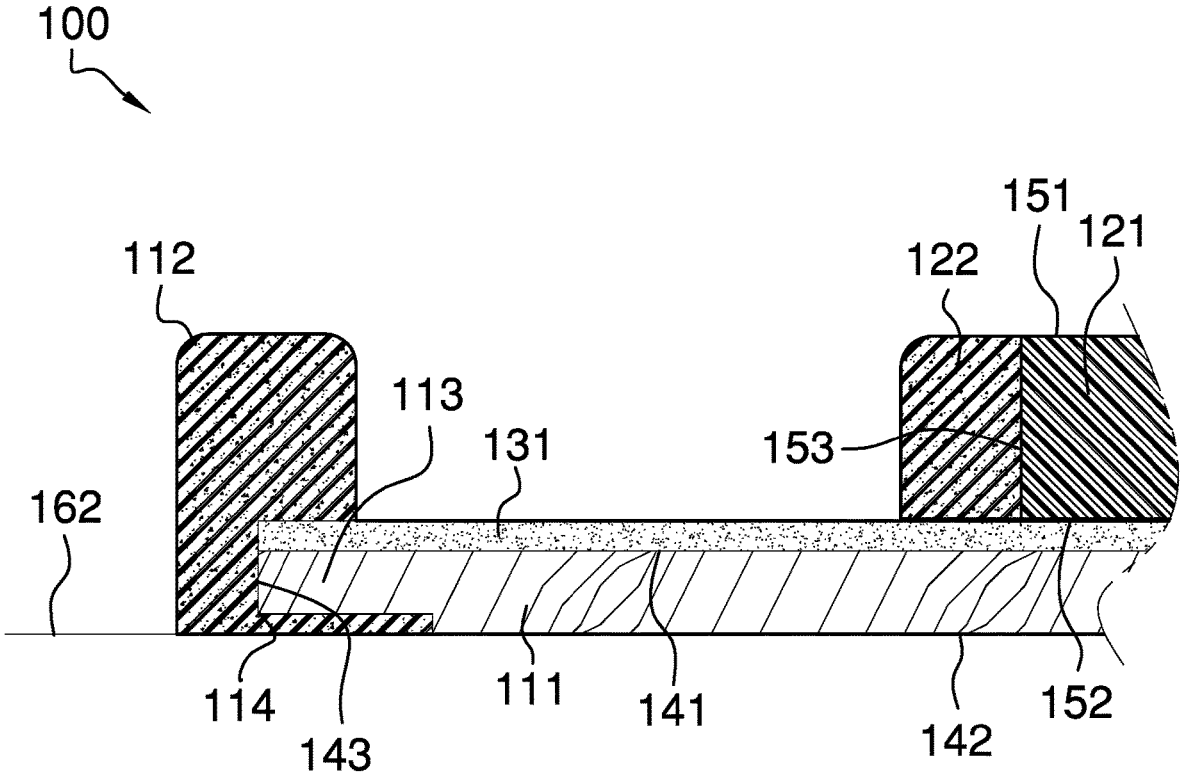
FIG. 4 is a cross-sectional view of an embodiment of the disclosure across 4-4 as shown in FIG. 3.

Detailed reference will now be made to one or more potential embodiments of the disclosure, which are illustrated in FIGS. 1 through 4.

The exercise slidermat 100 (hereinafter invention) is a physical training apparatus. The invention 100 is used for physical training in sports footwork. The invention 100 comprises a stationary saucer 101, a sliding structure 102, and an interface surface 103. The stationary saucer 101 is a pedestal upon which the sliding structure 102 is placed. The sliding structure 102 sits on a superior surface of the stationary saucer 101 such that the sliding structure 102 slides along the superior surface of the stationary saucer 101. The sliding structure 102 is a horizontal surface upon which an exerciser 161 performs training exercises intended to improve the footwork for a given sport. The sliding structure 102 is moved across the stationary saucer 101 such that the sliding structure 102 is moving across the stationary saucer 101 while the exerciser 161 is performing the training exercises. The action of combining the motion of the sliding structure 102 with the physical training causes the exerciser 161 to perform the training exercises while visually and tactilely sensing not only the motion of the training exercise but the forces and momentum applied to the sliding structure 102 during the training period. The additional stimuli of the forces and momentum created by the movement of the sliding structure 102 works to improve: 1) the overall balance of the exerciser 161; and, 2) the ability of the exerciser 161 to maintain proper footwork when facing the dynamic environment often associated with sports such as American football, soccer, wrestling, skiing or volleyball. The interface surface 103 is a low friction surface positioned between the stationary saucer 101 and the sliding structure 102.

Within this disclosure, the applicant previously refers to the concept of a momentum being applied to an exerciser 161. The applicant recognizes that, technically, momentum defines a Newtonian frame of reference that does not directly "act" on an individual within the frame of reference. The applicant uses this terminology as an informally descriptive but imprecise statement. The applicant believes this usage can be justified and the applicant clarifies this statement in the following two paragraph.

First, the applicant observes that the exerciser 161 will visually perceive an additional motion vector created by the sliding structure 102 that is not associated with the footwork training exercises. The applicant will point out that the interpretation of this additional motion vector by the brain of the exerciser 161 is not constrained by the Newtonian reference frame and is often interpreted as an illusion of a Newtonian force. Examples of this sort of spatial illusions are well-known and well-documented in the medical and psychological literature.

Second, the applicant will observe that the frictional forces and the changes in direction that are inherent in the invention 100 imply that the Newtonian reference frame created by the sliding structure 102 is continuously subjected to forces that will be tactilely sensed by the exerciser 161 during use of the invention 100. Stated more directly, the applicant believes that the momentum of the sliding structure 102 will experience constant changes during the normal use of the invention 100.

The stationary saucer 101 forms a pedestal upon which the sliding structure 102 is placed. The stationary saucer 101 has the shape of a disk-shaped saucer. The sliding structure 102 is contained within the perimeter of the stationary saucer 101 during normal use of the invention 100. The stationary saucer 101 is placed on a horizontal supporting surface 162 during normal use of the invention 100. The stationary saucer 101 comprises a stationary plate 111 and an outer ridge 112. The stationary plate 111 comprises a first superior surface 141, a first inferior surface 142, and a first lateral face 143.

The first superior surface 141 refers to the end of the stationary plate 111 that is distal from the first inferior surface 142. The first inferior surface 142 refers to the surface of the stationary plate 111 placed on the supporting surface 162 during normal use of the invention 100. The first lateral face 143 refers to a continuous surface that attaches the first superior surface 141 to the first inferior surface 142.

The stationary plate 111 is a disk-shaped structure. The stationary plate 111 supports the sliding structure 102 above the supporting surface 162. The sliding structure 102 is placed directly on the stationary plate 111. The stationary plate 111 is formed from polyoxymethylene (CAS 9002-81-7). The applicant prefers the use of polyoxymethylene (CAS 9002-81-7) in the formation of the stationary plate 111 because of the stiffness, strength, and low friction coefficient associated with polyoxymethylene (CAS 9002-81-7). The stationary plate 111 comprises a tenon 113.

The outer ridge 112 is a vertical surface that projects perpendicularly away from the first superior surface 141 of the stationary plate 111. The outer ridge 112 projects away from the stationary plate 111 in the superior direction. The outer ridge 112 is located along the circumference of the stationary plate 111 such that the outer ridge 112 forms a saucer in the stationary plate 111. The outer ridge 112 is a rigid structure. The outer ridge 112 contains the sliding structure 102 within the circumference. Specifically, the sliding structure 102 bounces off the outer ridge 112 when the sliding structure 102 hits the outer ridge 112. The applicant prefers the use of polyoxymethylene (CAS 9002-81-7) in the formation of the outer ridge 112 because of the stiffness, strength, and low friction coefficient associated with polyoxymethylene (CAS 9002-81-7) The outer ridge 112 comprises a mortise 114.

In the first potential embodiment, the outer ridge 112 attaches to the stationary plate 111 using a mortise 114 and tenon 113 structure. As shown most clearly in FIG. 4, the tenon 113 is a structure that projects radially away from the first lateral face 143 that forms the circumference of the disk of the stationary plate 111. The mortise 114 is a slot formed in the surface of the outer ridge 112 that is proximal to the circumference of the stationary plate 111. The outer ridge 112 attaches to the stationary plate 111 by inserting the tenon 113 into the mortise 114.

The sliding structure 102 is a disk-shaped structure. The sliding structure 102 is placed on the stationary saucer 101 such that the sliding structure 102 will slide along the stationary saucer 101. The sliding structure 102 comprises a sliding plate 121 and a bumper 122. The sliding plate 121 comprises a second superior surface 151, a second inferior surface 152, and a second lateral face 153.

The second superior surface 151 refers to the end of the sliding plate 121 that is distal from the second inferior surface 152. The second inferior surface 152 refers to the surface of the sliding plate 121 placed on the first inferior surface 142 of the stationary plate 111 during normal use of the invention 100. The second lateral face 153 refers to a continuous surface that attaches the second superior surface 151 to the second inferior surface 152.

The sliding plate 121 is a disk-shaped structure. The sliding plate 121 supports the exerciser 161 when the invention 100 is in use. The second inferior surface 152 of the sliding plate 121 rests on the first superior surface 141 of the stationary plate 111 when the invention 100 is in use. The applicant prefers the use of polyoxymethylene (CAS 9002-81-7) in the formation of the sliding plate 121 because of the stiffness, strength, and low friction coefficient associated with polyoxymethylene (CAS 9002-81-7).

The span of the outer diameter of the sliding plate 121 is lesser than the span of the inner diameter formed by the outer ridge 112 of the stationary plate 111 such that the sliding structure 102 can move within the stationary saucer 101.

The bumper 122 is an elastomeric material applied around the circumference formed by the second lateral face 153 of the disk structure that forms the sliding plate 121. The bumper 122 minimizes the potential for impact damage caused by the sliding structure 102 hitting the outer ridge 112 of the sliding structure 102. The applicant prefers the use of polychloroprene (CAS 9010-98-4) in the formation of the bumper 122.

The interface surface 103 is a low friction coating that is applied to the stationary saucer 101. The interface surface

103 forms a low friction surface between the stationary saucer 101 and the sliding structure 102 such that the stationary saucer will slide freely over the stationary saucer 101. The interface surface 103 comprises a PTFE coating 131.

The PTFE coating 131 is a low friction coating that is applied to the first superior surface 141 of the stationary plate 111. The PTFE coating 131 further reduces the frictional forces generated by the second inferior surface 152 of the sliding plate 121 sliding over the first superior surface 141 of the stationary plate 111. The applicant prefers the use of polytetrafluoroethylene (CAS 9002-84-0) in the formation of the PTFE coating 131 because of the low friction coefficient associated with polytetrafluoroethylene (CAS 9002-84-0).

This paragraph describes the use the invention 100. The second inferior surface 152 of the sliding plate 121 is placed on the first superior surface 141 of the stationary plate 111. The exerciser 161 then steps on the second superior surface 151 of the sliding plate 121 and begins the physical training exercise. The sliding plate 121 is then pushed while the exerciser 161 is performing the physical training exercise.

The following definitions were used in this disclosure:

Coating: As used in this disclosure, a coating refers to a substance applied to the exterior surface of an object such that the coating forms a new exterior surface of the object. A coating is commonly said to be formed as a layer.

Cylinder: As used in this disclosure, a cylinder is a geometric structure defined by two identical flat and parallel ends, also commonly referred to as bases, which are circular in shape and connected with a single curved surface, referred to in this disclosure as the lateral face. The cross-section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Disk: As used in this disclosure, a disk is a cylindrically shaped object that is flat in appearance.

Elastic: As used in this disclosure, an elastic is a material or object that deforms when a force is applied to it and that is able to return to its relaxed shape after the force is removed. A material that exhibits these qualities is also referred to as an elastomeric material.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity.

Inner Diameter: As used in this disclosure, the term inner diameter is used in the same way that a plumber would refer to the inner diameter of a pipe.

Load Path: As used in this disclosure, a load path refers to a chain of one or more structures that transfers a load generated by a raised structure or object to a foundation, supporting surface, or the earth.

Mortise: As used in this disclosure, a mortise is a cavity formed in a material that is designed to receive a similarly shaped object such that the similarly shaped object is flush to the surface of the material.

Negative Space: As used in this disclosure, negative space is a method of defining an object through the use of open or empty space as the definition of the object itself, or, through the use of open or empty space to describe the boundaries of an object.

Neoprene: As used in this disclosure, neoprene is a popular name for polychloroprene (CAS 9010-98-4).

Outer Diameter: As used in this disclosure, the term outer diameter is used in the same way that a plumber would refer to the outer diameter of a pipe.

Pedestal: As used in this disclosure, a pedestal is an intermediary load bearing structure that that transfers a load path between a supporting surface and an object, structure, or load.

Perimeter: As used in this disclosure, a perimeter is one or more curved or straight lines that bounds an enclosed area on a plane or surface. The perimeter of a circle is commonly referred to as a circumference.

Plate: As used in this disclosure, a plate is a smooth, flat and rigid object that has at least one dimension that: 1) is of uniform thickness; and 2) that appears thin relative to the other dimensions of the object. Plates often have a rectangular or disk-like appearance. As defined in this disclosure, plates may be made of any material, but are commonly made of metal.

Radial: As used in this disclosure, the term radial refers to a direction that: 1) is perpendicular to an identified central axis; or, 2) projects away from a center point.

Ridge: As used in this disclosure, a ridge is a vertical surface that projects away from a horizontal surface.

Rigid Structure: As used in this disclosure, a rigid structure is a solid structure formed from an inelastic material that resists changes in shape. A rigid structure will permanently deform as it fails under a force.

Rim: As used in this disclosure, a rim is an outer edge or border that follows along the perimeter of an object.

Ring: As used in this disclosure, a ring is a term that is used to describe a flat or plate-like structure through which an aperture is formed. Rings are often considered loops.

Slide: As used in this disclosure, slide is a verb that refers to an object that is transported along a surface while in continuous contact with the surface. An object being transported along a surface with wheels cannot be said to be sliding.

Superior: As used in this disclosure, the term superior refers to a directional reference that is parallel to and in the opposite direction of the force of gravity.

Supporting Surface: As used in this disclosure, a supporting surface is a horizontal surface upon which an object is placed and to which the load path of the object is transferred. Within this disclosure, it is assumed that the object is placed on the supporting surface in an orientation that is appropriate for the normal or anticipated use of the object.

Tenon: As used in this disclosure, a tenon is a structure that projects away from an edge a first object (often the end of a piece of wood). The tenon is sized and shaped to fit into a mortise formed in a second object such that the first object can be attached to the second object by inserting the tenon in the matching mortise.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An exercise apparatus comprising:

a stationary saucer, a sliding structure, and an interface surface;

wherein the stationary saucer is a pedestal upon which the sliding structure is placed;

wherein the interface surface is a surface positioned between the stationary saucer and the sliding structure;

wherein the exercise apparatus is used for a training exercise in sports footwork;

wherein the sliding structure is configured to move across the stationary saucer while an exerciser is performing the training exercise;

wherein a momentum of the sliding structure is configured to constantly change during the use of the exercise apparatus;

wherein the stationary saucer has a shape of a disk-shaped saucer;

wherein the sliding structure is a disk-shaped structure;

wherein the sliding structure is contained within a perimeter of the stationary saucer.

2. The exercise apparatus according to claim 1 wherein the stationary saucer is configured to be placed on a horizontal supporting surface.

3. The exercise apparatus according to claim 2 wherein the interface surface forms a low friction surface between the stationary saucer and the sliding structure such that the stationary saucer will slide freely over the stationary saucer.

4. The exercise apparatus according to claim 3 wherein the stationary saucer comprises a stationary plate and an outer ridge;

wherein the outer ridge attaches to the stationary plate;

wherein the stationary plate comprises a first superior surface, a first inferior surface, and a first lateral face.

5. The exercise apparatus according to claim 4 wherein the stationary plate is a disk-shaped structure;

wherein the stationary plate is configured to support the sliding structure above the supporting surface;

wherein the sliding structure is placed directly on the stationary plate.

6. The exercise apparatus according to claim 5 wherein the outer ridge is a vertical surface;

wherein the outer ridge projects perpendicularly away from the first superior surface of the stationary plate in a vertical direction;

wherein the outer ridge is located along a circumference of the stationary plate such that the outer ridge forms the stationary saucer in the stationary plate.

7. The exercise apparatus according to claim 6 wherein the outer ridge is a rigid structure;

wherein the outer ridge contains the sliding structure within the circumference of the stationary plate.

8. The exercise apparatus according to claim 7 wherein the stationary plate comprises a tenon;

wherein the outer ridge comprises a mortise;

wherein the outer ridge attaches to the stationary plate using a mortise and tenon structure.

9. The exercise apparatus according to claim 8 wherein the tenon is a structure that projects radially away from the first lateral face that forms the circumference of the disk-shaped structure of the stationary plate;

wherein the mortise is a slot formed in a surface of the outer ridge that is proximal to the circumference of the stationary plate;

wherein the outer ridge attaches to the stationary plate by inserting the tenon into the mortise.

10. The exercise apparatus according to claim 9 wherein the sliding structure comprises a sliding plate and a bumper;

wherein the bumper attaches to the sliding plate;

wherein the sliding plate comprises a second superior surface, a second inferior surface, and a second lateral face.

11. The exercise apparatus according to claim 10 wherein the sliding plate is a disk-shaped structure;

wherein the sliding plate is configured to support the exerciser when the exercise apparatus is in use;

wherein the second inferior surface of the sliding plate rests on the first superior surface of the stationary plate.

12. The exercise apparatus according to claim 11 wherein a span of an outer diameter of the sliding plate is lesser than a span of an inner diameter formed by the outer ridge of the stationary plate.

13. The exercise apparatus according to claim 12 wherein the bumper is an elastomeric material.

14. The exercise apparatus according to claim 13 wherein the bumper is applied around a circumference formed by the second lateral face of the disk-shaped structure of the sliding plate.

* * * * *